US005803147A

United States Patent [19]

Kondo et al.

[11] Patent Number: 5,803,147

[45] Date of Patent: Sep. 8, 1998

[54] VERTICAL BLIND

[75] Inventors: Masayoshi Kondo; Zenichi Oda; Michio Okumura; Akinori Kimata, all of Anjo, Japan

[73] Assignee: Makita Corporation, Aichi-ken, Japan

[21] Appl. No.: 696,223

[22] Filed: Aug. 13, 1996

[30] Foreign Application Priority Data

Aug. 16, 1995 [JP] Japan ..... 7-208761

[51] Int. Cl.[6] ..... E06B 9/36

[52] U.S. Cl. ..... 160/168.1 V; 160/176.1 V

[58] Field of Search ..... 160/168.1 V, 173 V, 160/176.1 V, 177 V

[56] References Cited

U.S. PATENT DOCUMENTS 3,280,891 10/1966 Eldredge, Jr. et al. .
4,628,981 12/1986 Ciriaci et al. ..... 160/168.1 V X
4,736,784 4/1988 Boloix ..... 160/168.1 V
4,914,360 4/1990 Hsieh et al. ..... 160/168.1 P X

*Primary Examiner*—Blair Johnson
*Attorney, Agent, or Firm*—Davis and Bujold

[57] ABSTRACT

To avoid entanglement when a vertical blind is opened and closed, an attachment member is secured to a lead carrier and engages with an operation shaft. The attachment member is composed of a body having a length half the width of the lead carrier, and a snap detent projects from one end of the body. The body is formed by cutting an upper part of a horizontal cylindrical member and opening outwardly the cut edges of the body. The attachment member is attached to the operation shaft from the underside in an oblique direction such that the body engages with the lower part of the operation shaft and the snap detent snap engages with the upper part of a short jaw. Even when rotary moment is applied to the lead carrier, the attachment member holding the operation shaft counteracts the rotary moment, thereby preventing the lead carrier from rotating.

16 Claims, 8 Drawing Sheets

VERTICAL BLIND

FIELD OF THE INVENTION

This invention relates to vertical blinds in general, and more particularly to vertical blinds in which carriers are reciprocated with a looped operation string.

BACKGROUND OF THE INVENTION

Conventionally, a vertical blind, as disclosed in U.S. Pat. No. 3,280,891 and as shown in FIG. 8A and 8B, is provided with a plurality of carriers 110 each composed of a hook 111 for holding a vertical louver 100, a hook rotation mechanism 113 for rotating the hook 111 around a vertical axis, and opposed rollers 115. The vertical blind is also provided with a rolling contact surface 121 for supporting the opposed rollers 115 of carrier 110. In the vertical blind, the carriers 110 are housed within a hanger rail 120, an operation shaft 130 is disposed along the hanger rail 120 and inserted through a shaft insertion hole 117 formed in the carriers 110 for operating the hook rotation mechanism 113, and an operation string 140 is inserted through two string insertion holes 118, 119 formed in each carrier 110 to form a continuous loop and is secured to a lead carrier 110L for reciprocating the lead carrier 110L. The vertical blind is further provided with a pantograph-shaped metal connector 150 for interconnecting the carriers 110, such that the remaining carriers 110 reciprocate along with reciprocation of the lead carrier 110L.

However, conventional vertical blinds are not without shortcomings. As shown in FIG. 8C, when the operation string 140 is reciprocated, the lead carrier 110L is rotated around the vertical axis so that the opposed rollers 115 are not aligned with the rolling contact surface 121. Consequently, the desired smooth reciprocation becomes irregular or rough and ultimately leads to the load carrier 110L becoming tangled or twisted within the hanger rail 120.

Sometimes an electric motor is used for opening and closing the vertical blind. In this arrangement, if the lead carrier becomes entangled, the electric motor is overloaded, thereby failing to open or close the vertical blind. Additionally, if an electric motor having a large rated current is used, excess force is applied to the lead carrier, the hanger rail and other associated components. Such electric motors deteriorate the durability of the vertical blind components and increase the cost, and therefore are not an appropriate solution.

SUMMARY OF THE INVENTION

Wherefore, an object of the present invention is to prevent entanglement of an operation string and a lead carrier when a vertical blind is opened or closed.

To attain this and other objects, the present invention provides a first type of vertical blind provided with a plurality of carriers housed in a hanger rail for hanging vertical louvers thereon and an operation string first inserted through a first string insertion hole in each carrier and then through a second string insertion hole in each carrier to form a continuous loop. The operation string is secured, in a conventional manner, to the lead carrier. By reciprocation of the operation string, the lead carrier is reciprocated within and along the hanger rail, thereby also reciprocating the other carriers. A means is provided for preventing a rotary moment from acting on the lead carrier when the operation string is reciprocatingly operated.

In the first type of vertical blind, by eliminating or minimizing rotary moment applied to the lead carrier at the time of reciprocation of the operation string, the lead carrier is prevented from rotating and being tangled or twisted.

Specifically, the first string insertion hole is formed along a center line of each carrier and the second string insertion hole is spaced from the center line. The lead carrier is secured by tying the operation string to the first string insertion hole. Conventionally, the string insertion holes are provided symmetrical with respect to each other relative to the center line of the carrier. According to the invention, the conventional way of thinking is reversed and the string insertion holes are provided asymmetrically relative to the center line of the carrier for smoothly reciprocating the operation string.

In the first type of vertical blind, the reciprocating force applied to the lead carrier is focused on the center line of the carrier. Therefore, no or only a slight rotary moment arises for rotating the carrier around a vertical axis. The lead carrier is thus prevented from rotating or being twisted.

The present invention provides a second type of vertical blind provided with a plurality of carriers housed in a hanger rail for hanging vertical louvers thereon and an operation string inserted first through a first string insertion hole in each carrier and then through a second string insertion hole in each carrier to form a continuous loop. By reciprocation of the operation string secured to a lead carrier, the lead carrier is reciprocated within and along the hanger rail, thereby reciprocating all of the other carriers. A means is provided for supplying the lead carrier with a force counteracting the rotary moment when the operation string is reciprocatingly operated and rotary moment acts on the lead carrier, thereby preventing the lead carrier from rotating.

In the second type of vertical blind, the force counteracting any rotary moment arising on the lead carrier and prohibits the lead carrier from rotating or being tangled or twisted.

Specifically, each carrier for hanging the vertical louver thereon is provided with a rotation mechanism for rotating the louver around a vertical axis and a shaft insertion hole for passing an operation shaft for the rotation mechanism. An operation shaft guide member extends through the shaft insertion hole in the lead carrier for holding the operation shaft and is provided with the sufficient length for inhibiting rotation of the reciprocating lead carrier around the vertical axis.

In the vertical blind, the operation shaft is held by the operation shaft guide member, of a sufficient length, secured to the lead carrier, and the operation shaft guide member counteracts the moment for rotating the lead carrier around a vertical axis, thereby avoiding entanglement of the lead carrier.

The operation shaft guide member can be integrally formed with the lead carrier. Alternatively, the operation shaft guide member includes an attachment member which is detachably attached to the lead carrier. The operation shaft guide member opens upwardly and can be advantageously attached to the lead carrier without disassembling the vertical blind, such that the operation shaft guide member can engage with the lower part of the operation shaft. The provision of a snap engagement member on the attachment member further facilitates the engagement of the operation shaft guide member with the lead carrier. The configuration of the operation shaft guide member is not limited to an opened horizontal cylinder.

In the second type of vertical blind, the lead carrier can be provided with a hanger rail guide member for engaging with an inner wall of the hanger rail to prevent the lead carrier from rotating around a vertical axis.

When rotary moment around the vertical axis is applied to the lead carrier, the guide member engages with the inner wall of the hanger rail and counteracts such rotary moment. Therefore, the lead carrier is prevented from rotating and being tangled. The guide member has horizontal rollers which have a slide fitting with the inner wall of the hanger rail. Although the guide member is not limited to horizontal rollers, the guide member should be formed from a material selected such that the friction coefficient of the contact face of the guide rail with the inner wall of the hanger rail can be minimized. The guide member can be formed of an attachment member detachably attached to the lead carrier and having an insertion hole for receiving the hook with the louver hung thereon. The attachment member can be easily attached to the lower part of the lead carrier.

As aforementioned, according to the present invention, the lead carrier is effectively prevented from rotating or being tangled. Therefore, the vertical blind can be manually operated with a moderate force and without a minute operational adjustment of the operation string. The vertical blind can be economically operated with a small-sized electrical motor. Furthermore, according to the present invention, the lead carrier, the hanger rail and other associated components of the vertical blind can be protected from damage and can have improved durability.

The vertical blind of the present invention, which is opened and closed by reciprocation of the looped operation string, can also provide a conventional advantage in that the vertical blind can be opened and closed just by pulling one end of the operation string and even an excessively opened vertical blind can be easily adjusted.

BRIEF DESCRIPTION OF THE DRAWINGS

The invention will now be described, by way of example, with reference to the drawings, in which.

DETAILED DESCRIPTION OF THE PREFERRED EMBODIMENTS

Basically in the same manner as the conventional vertical blind, a vertical blind according to the embodiments of the present invention is provided with a plurality of carriers composed of a hook for holding a vertical louver, a hook rotation mechanism for rotating the hook around a vertical axis, and opposed rollers. The vertical blind is also provided with a rolling contact surface R for supporting the opposed rollers. In the vertical blind, the carriers are housed within a hanger rail H, an operation shaft is disposed along the hanger rail H and inserted through a shaft insertion hole formed in the carriers for operating the hook rotation mechanism, and an operation string is inserted through two string insertion holes formed in each carrier to form a continuous loop and secured to a lead carrier for reciprocating the lead carrier. The vertical blind is further provided with a scissor or pantograph-shaped metal connector P for interconnecting the carriers, such that the carriers reciprocate along with reciprocation of the lead carrier, and metal fittings Q for attaching the metal connector P to the carriers.

Figure 1A:
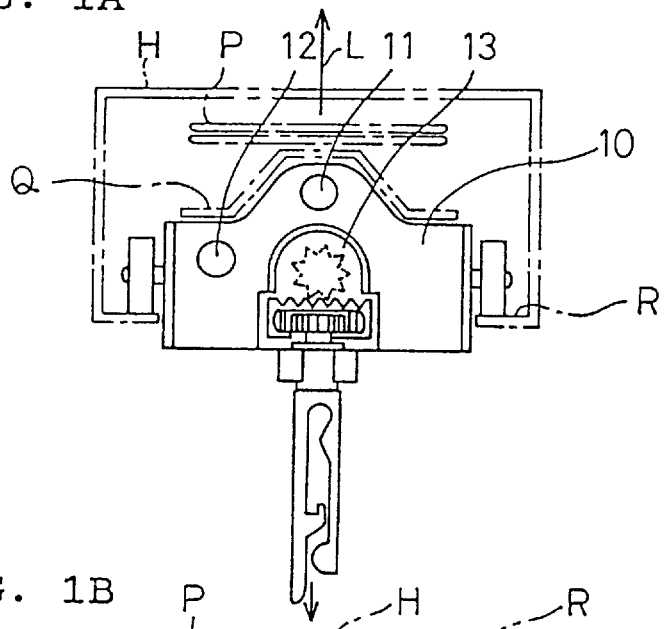
FIG. 1A is a right side view of a carrier for a vertical blind according to a first embodiment.
Figure 1B:
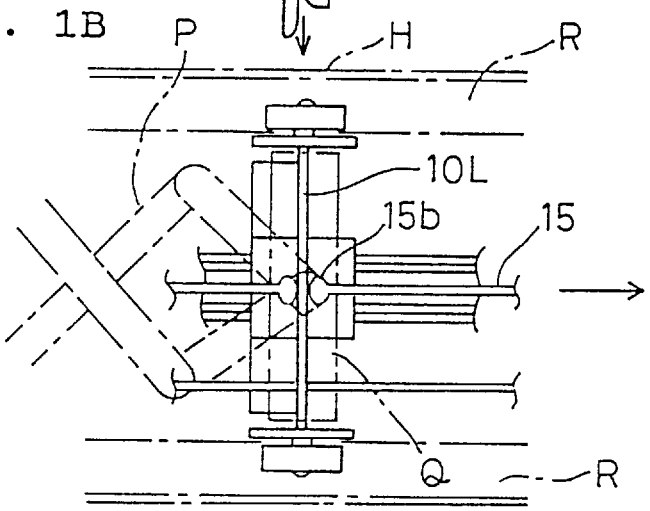
FIG. 1B is a plan view thereof and FIG. 1C is a front view thereof.
Figure 1C:
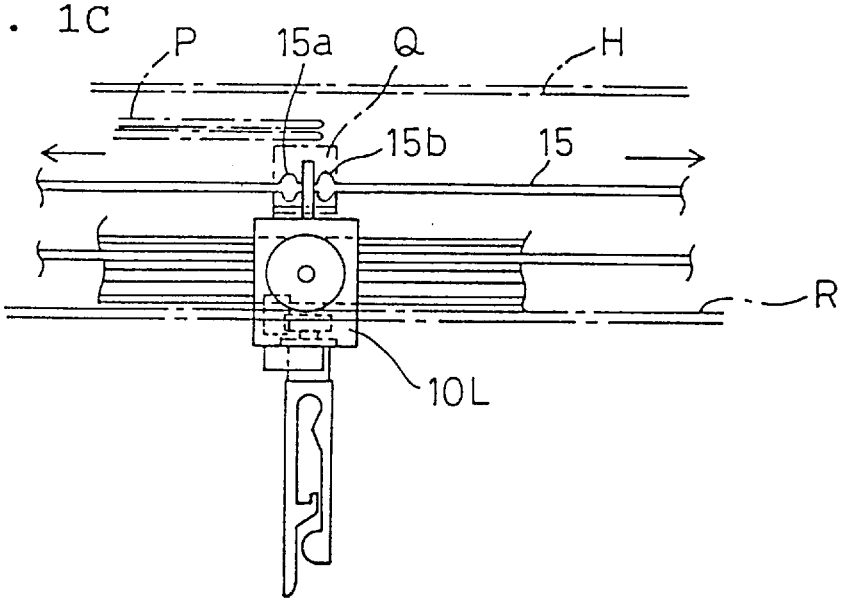

In the first embodiment, as shown in FIGS. 1A, 1B and 1C, two string insertion holes 11 and 12 are positioned asymmetrically in a carrier 10, different from the conventional vertical blind. The string insertion hole 11 is formed along a vertical center line L of carrier 10 and right above an operation shaft insertion hole 13. As shown in FIGS. 1B and 1C, a lead carrier 10L and an operation string 15 are connected to each other, by tying the operation string 15 and making knots 15*a* and 15*b* at locations on both sides of the string insertion hole 11. Even when the operation string 15 is reciprocated, no or only a slight rotary moment acts on the lead carrier 10L, and no significant tangling arises.

Figure 2A:
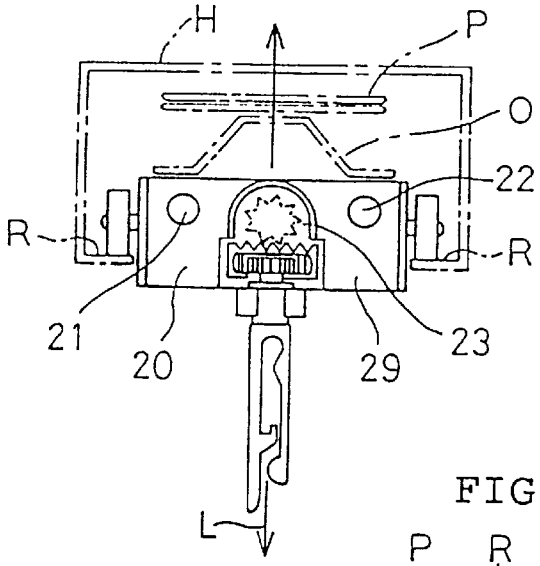
FIG. 2A is a right side view of a carrier according to a second embodiment.
Figure 2B:
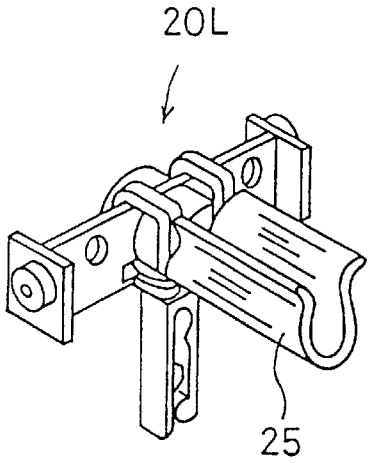
FIG. 2B is a perspective view thereof.
Figure 2C:
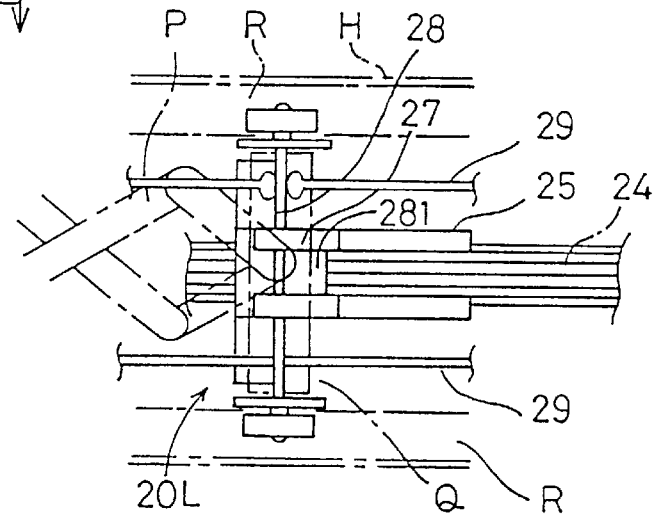
FIG. 2C is a plan view thereof and FIG. 2D is a front view thereof.
Figure 2D:
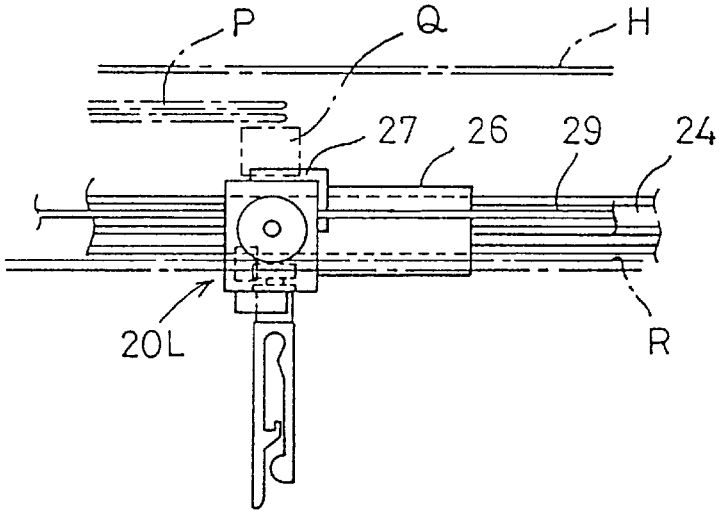

The second embodiment is now explained. As shown in FIG. 2A, string insertion holes 21 and 22 are positioned symmetrically relative to a center line L of a carrier 20 in the same manner as a conventional vertical blind. As shown in FIGS. 2B, 2C and 2D, a shaft insertion hole 23 in a lead carrier 20L receives an attachment member 25 extending along an operation shaft 24.

Figure 3A:
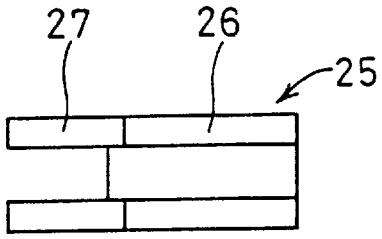
FIG. 3A is a plan view of the jaw member of the second embodiment.
Figure 3B:
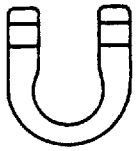
FIG. 3B is a left side view thereof.
Figure 3C:
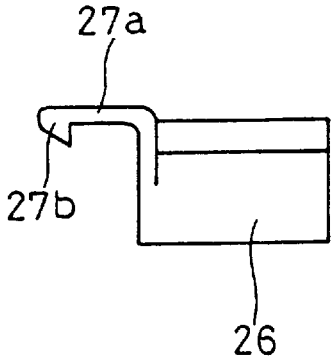
FIG. 3C is a front view thereof and FIG. 3D is a right side view thereof.
Figure 3D:
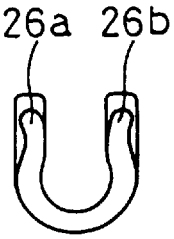

The attachment member 25 is, as shown in FIG. 3A, composed of a body 26 having the length half the width of lead carrier 20L, and a snap detent 27 integrally projected from the end of body 26. As shown in FIGS. 3C and 3D, the body 26 is formed by cutting the upper part of a horizontal cylindrical member along a longitudinal axis and opening outwardly the opposed cut edges 26*a* and 26*b*. The snap detent 27 is, as shown in FIG. 3C, composed of arms 27*a* having the same length as that of a short jaw 281 plus a center plate 28 having the shaft insertion hole 23 of lead carrier 20L, and a detent 27*b* projected downward from the tip of the arm 27*a*. The attachment member 25 is attached to the lower periphery of (support structure) operation shaft 24 from the underside in an oblique direction, such that the body 26 is engaged with the operation shaft 24 and the snap detent 27 is snapped with the upper part of center plate 28.

In the second embodiment, when an operation string 29 is reciprocatingly operated, rotary moment is applied to the lead carrier 20L. The attachment member 25, holding the operation shaft 24, acts against the rotary moment thereby preventing the lead carrier 20L from rotating. Therefore, without causing any entanglement, the vertical blind can be easily opened and closed. A conventional vertical blind can be easily modified with the attachment member 25. Since the edges 26*a* and 26*b* of attachment member 25 open outwardly, the operation shaft 24 can be easily inserted into the attachment member 25. The body 26 of attachment member 25 can be easily attached from the underside to the lower part of shaft 24 by the edges 26*a* and 26*b*. Thus, the elaborated attachment member 25 can modify the vertical blind without changing the conventional structure of the vertical blind.

Figure 4A:
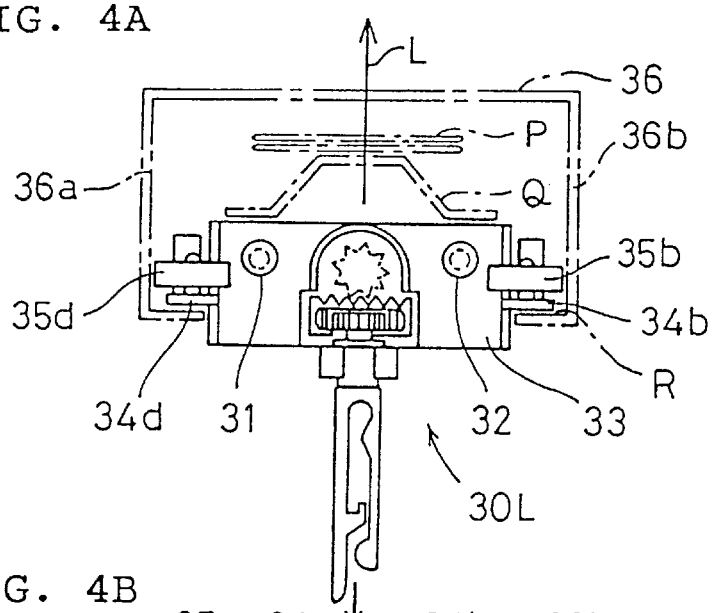
FIG. 4A is a right side view of a carrier according to a third embodiment.
Figure 4B:
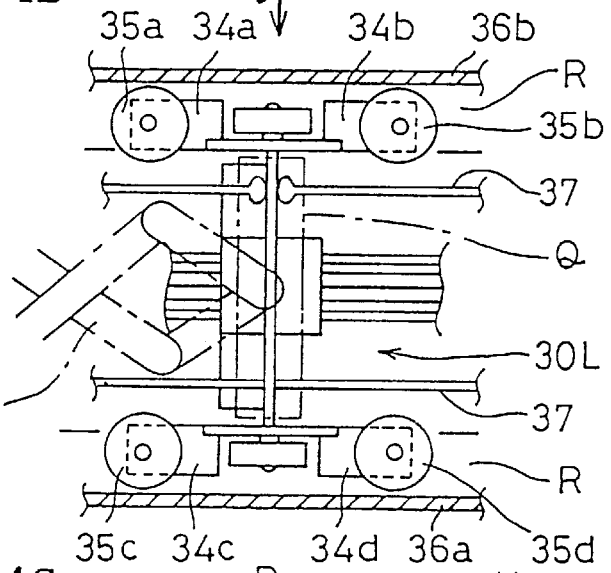
FIG. 4B is a plan view thereof and FIG. 4C is a front view thereof.
Figure 4C:
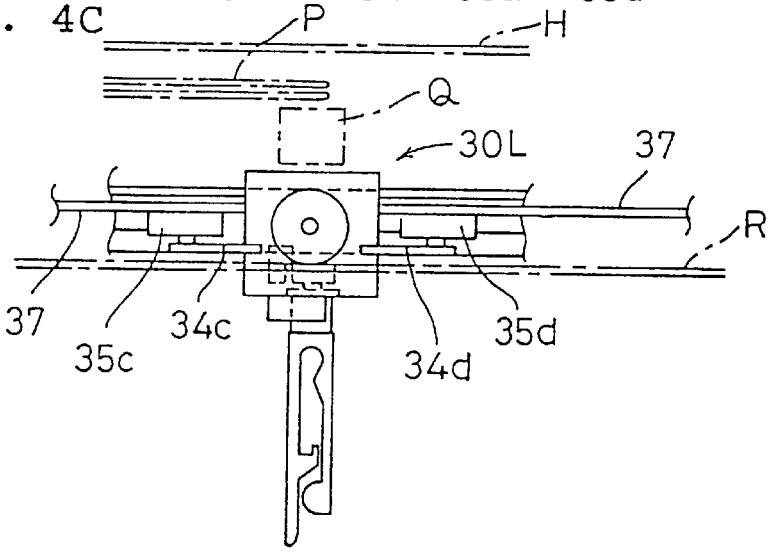

The third embodiment is now explained referring to FIGS. 4A, 4B and 4C.

As shown in FIG. 4A, string insertion holes 31 and 32 in a lead carrier 30L are disposed symmetrically relative to the center line L of lead carrier 30L, in the same manner as in a conventional vertical blind. Arms 34*a* thru 34*d* extend from the ends of a body 33 of lead carrier 30L, and are provided with horizontal rollers 35*a* thru 35*d*, respectively. The horizontal rollers 35*a* thru 35*d* engage with vertical inner walls 36*a* and 36*b* of (support structure) hanger rail 36, thereby preventing the lead carrier 30L from rotating. Thus, when operation string 37 is reciprocatingly operated, entanglement of the lead carrier 30L can be avoided.

In the aforementioned embodiments, since no entanglement is caused in the lead carrier, the operation string can be reciprocatingly operated with a small electric motor. Therefore, the durability of the vertical blind can be enhanced.

Figure 5:
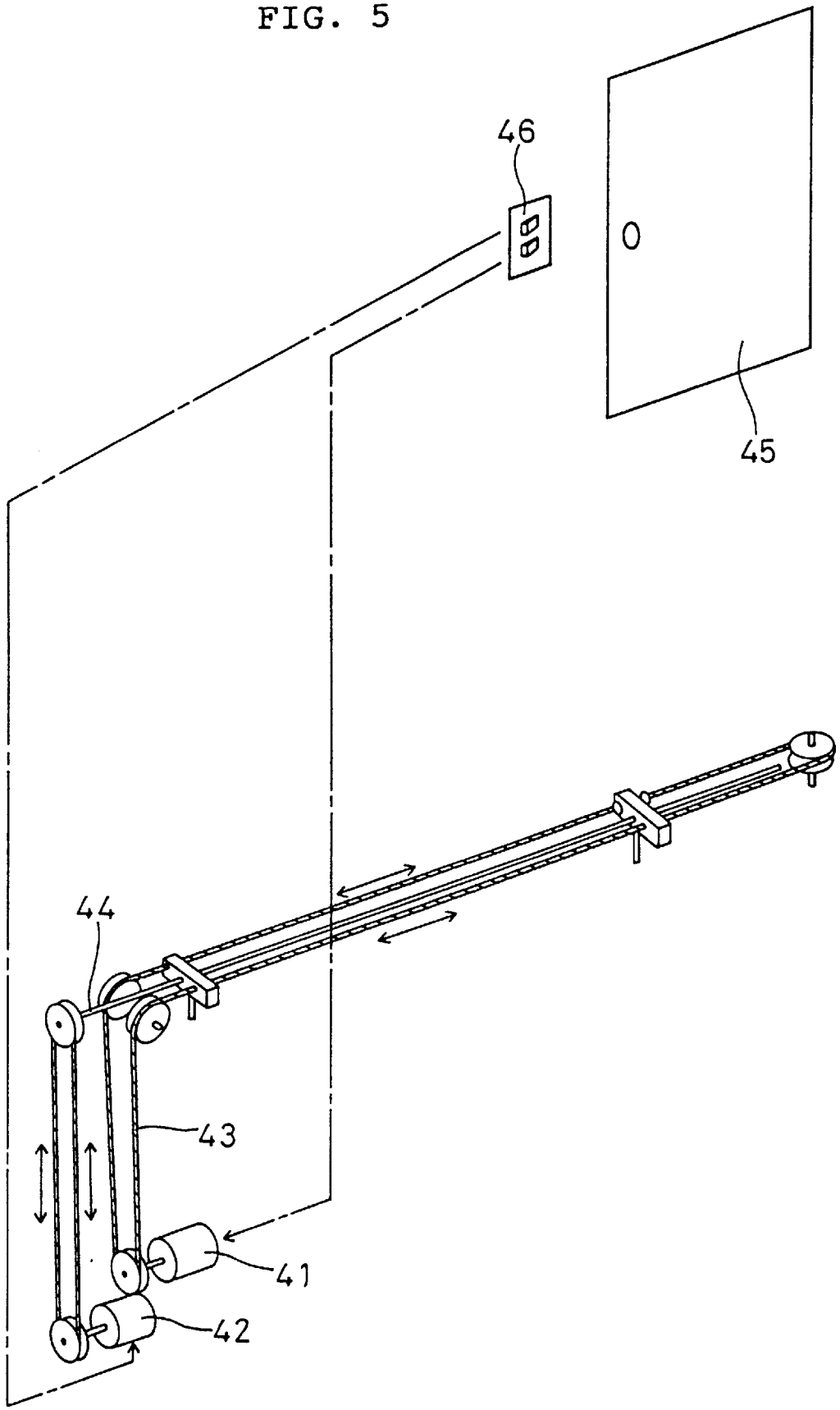
FIG. 5 is a diagrammatic perspective view of a motor drive system applicable for the vertical blinds according to the embodiments.

For example, as shown in FIG. 5, an operation string 43 and an operation shaft 44 are driven with electric motors 41 and 42, respectively. Power switches 46 are desirably provided remote from the electric motors 41 and 42 and adjacent to a room door 45, for example.

Figure 6A:
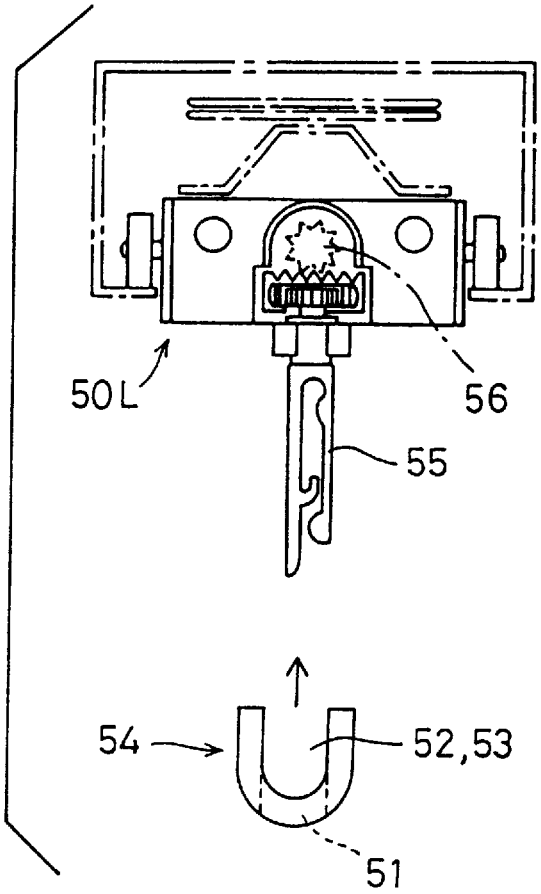
FIG. 6A is a right side view of a modification of the second embodiment and FIG. 6B is a bottom view thereof.
Figure 6B:
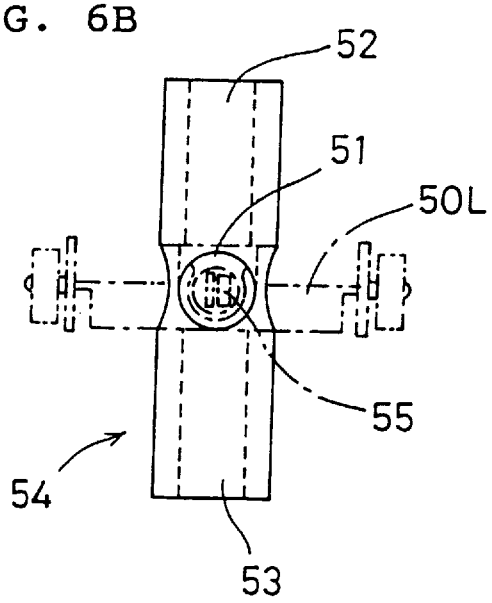

To avoid entanglement in a known lead carrier 50L by firmly holding an operation shaft 56, as shown in FIG. 6A, an attachment member 54 provided with a center hole 51 and opposed U-shaped receiving parts 52 and 53 can be attached to the lower part of the operation shaft 56, by inserting hook 55 through the center hole 51, as shown in FIG. 6B.

Figure 7A:
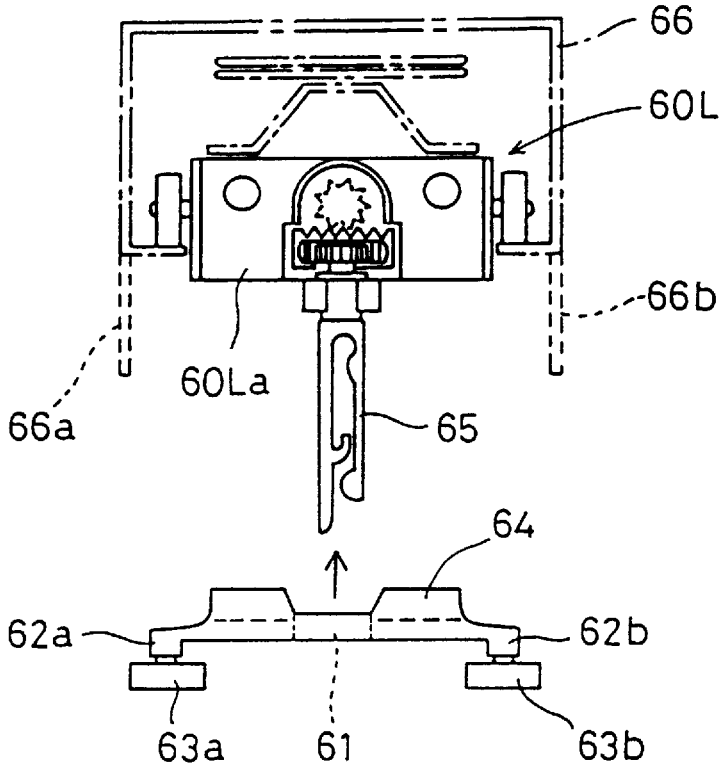
FIG. 7A is a right side view of a modification of the third embodiment and FIG. 7B is a bottom view thereof.
Figure 7B:
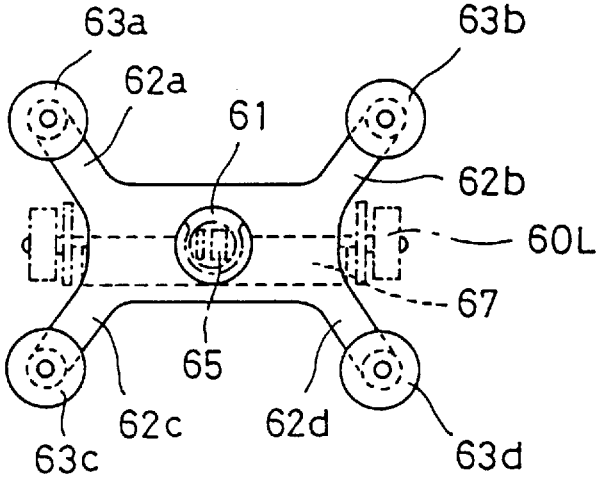
Figure 8A:
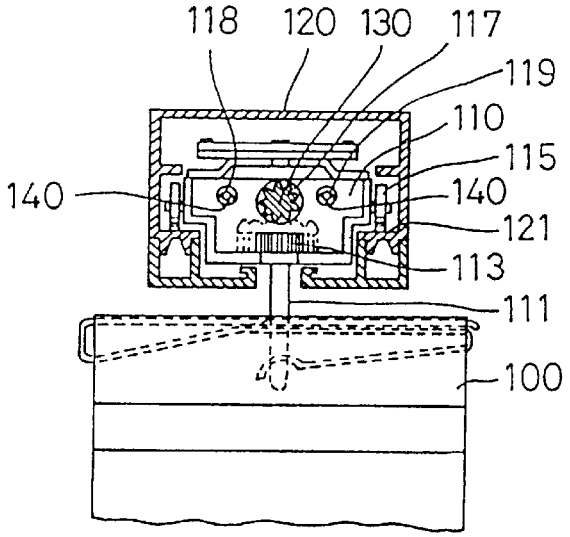
FIG. 8A PRIOR ART
FIG. 8A is a right side view of a conventional prior art vertical blind.
Figure 8B:
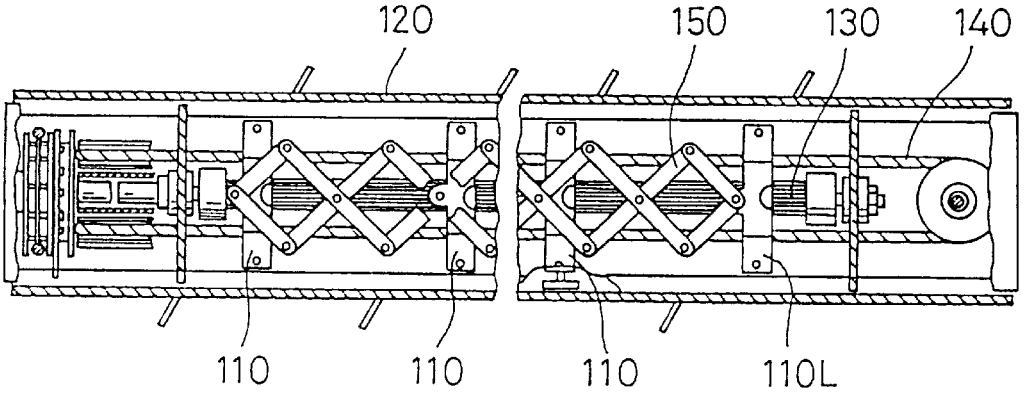
FIG. 8B PRIOR ART
FIG. 8B is a plan view thereof and FIG. 8C is a horizontal cross-sectional view thereof.
Figure 8C:
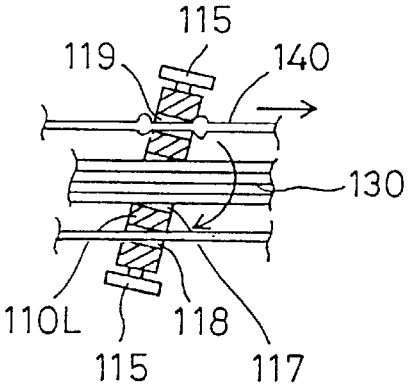
FIG. 8C PRIOR ART

To avoid entanglement in a known lead carrier 60L by providing horizontal rollers 63*a* thru 63*d*, as shown in FIG. 7A, an attachment member 64 is provided with a center hole 61, arms 62*a* and 62*c* extend in a first direction, arms 62*b* and 62*d* extend in an opposite direction, and the horizontal rollers 63*a* thru 63*d* are attached to the arms 62*a* thru 62*d*, respectively. The attachment member 64 is attached to the lower part of lead carrier 60L by inserting hook 65 through the center hole 61, as shown in FIG. 7B. As required, vertical walls 66*a* and 66*b* are extended from a hanger rail 66. A groove 67 can be formed in the attachment member 64 for engaging with the lower part of a body 60La of lead carrier 60L.

This invention has been described above with reference to the preferred embodiments as shown in the figures. Modifications and alterations may become apparent to one skilled in the art upon reading and understanding the specification. Despite the use of the embodiment for illustration purposes, the invention is intended to include all such modifications and alterations within the spirit and scope of the appended claims.

What is claimed is:

1. A vertical blind assembly comprising:

a hanger rail;

a lead carrier and a plurality of follower carriers, for hanging vertical louvers thereon, all being housed within said hanger rail;

an operation string first inserted through a first string insertion hole formed in said lead carrier and in each of said plurality of carriers and thereafter being inserted through a second string insertion hole formed in said lead carrier and in each of said plurality of carriers so that said operation string is formed into a continuous loop, and said operation string being connected to said lead carrier for controlling movement of said lead carrier within said hanger rail;

a mechanical connector interconnecting said plurality of carriers and said lead carrier so that as said lead carrier is reciprocated within and along said hanger rail by said operation string, said plurality of carriers are also similarly reciprocated;

said lead carrier and said plurality of carriers each include a rotation mechanism for rotating a supported louver about a vertical axis and a shaft insertion hole receiving an operation shaft for engaging and operating said rotation mechanism; and means for preventing rotary moment from being applied to said lead carrier when said operation string is reciprocated;

wherein said means for preventing rotary moment from being applied to said lead carrier is an attachment member which is detachably attached to said lead carrier and engages with said operation shaft at a location spaced from the engagement of said operation shaft and said rotation mechanism to prevent rotary moment from being applied to said lead carrier during reciprocation of said operation string.

2. A vertical blind according to claim 1, wherein each of said plurality of carriers and said lead carrier define a center line extending horizontally along said hanger rail, and said first string insertion hole is formed along said center line of said lead carrier and each of said plurality of carriers and said second string insertion hole is spaced from said center line.

3. A vertical blind according to claim 1, wherein said operation string is secured to said lead carrier by tying a knot in said operation string adjacent opposed sides of said first string insertion hole.

4. A vertical blind according to claim 1, wherein said mechanical connector is a scissor-type connector interconnecting said plurality of carriers with said lead carrier for simultaneous movement of said plurality of carriers and said lead carrier.

5. A vertical blind according to claim 1, wherein an electric motor, having a drive mechanism, is drivingly connected to said operation string for controlling operation of said operation string, and said electric motor is connected to an electrical control mechanism for controlling operation of said electric motor.

6. A vertical blind assembly comprising:

a hanger rail;

a lead carrier and a plurality of follower carriers, for hanging vertical louvers thereon, all being housed within said hanger rail;

an operation string first inserted through a first string insertion hole formed in said lead carrier and in each of said plurality of carriers and thereafter being inserted through a second string insertion hole formed in said lead carrier and in each of said plurality of carriers so that said operation string is formed into a continuous loop, and said operation string being connected to said lead carrier for controlling movement of said lead carrier within said hanger rail;

a mechanical connector interconnecting said plurality of carriers and said lead carrier so that as said lead carrier is reciprocated within and along said hanger rail by said operation string, said plurality of carriers are also similarly reciprocated;

said lead carrier and said plurality of carriers each include a rotation mechanism for rotating supported louvers about vertical axes and a shaft insertion hole receiving an operation shaft for engaging and operating said rotation mechanism; and means for providing said lead carrier with a force counteracting a rotary force applied to said lead carrier during reciprocation of said operation string thereby preventing said lead carrier from rotating within said hanger rail;

wherein said means for providing said lead carrier with a force counteracting a rotary force applied to said lead carrier is an attachment member which is detachably attached to said lead carrier and engages with said operation shaft at a location spaced from the engagement of said operation shaft and said rotation mechanism to prevent rotary moment from being applied to said lead carrier during reciprocation of said operation string.

7. A vertical blind according to claim 6, wherein a sufficient length of said attachment member supports said operation shaft such that said lead carrier, when reciprocated, is prevented from rotating about the vertical axis.

8. A vertical blind according to claim 7, wherein said attachment member is a member having a U-shaped cross-section which has an elongate cutting provided therein and said operation shaft engages with said elongate cutting.

9. A vertical blind according to claim 6, wherein said attachment member is provided with a center hole and opposed U-shaped receiving portions which each support a portion of said operation shaft.

10. A vertical blind according to claim 9, wherein said center hole receives a hook supported by said lead carrier.

11. A vertical blind according to claim 7, wherein said attachment has a length which is half the width of said lead carrier and is provided with a pair of arms which facilitate the detachable attachment of said attachment member to said lead carrier.

12. A vertical blind according to claim 6, wherein an electric motor, having a drive mechanism, is drivingly connected to said operation string for controlling operation of said operation string, and said electric motor is connected to an electrical control mechanism for controlling operation of said electric motor.

13. A vertical blind according to claim 6, wherein said attachment member has a longitudinal groove extending therethrough which receives said operation shaft.

14. A vertical blind assembly comprising:

a hanger rail;

a lead carrier and a plurality of follower carriers, for hanging vertical louvers thereon, all being housed within said hanger rail;

an operation string first inserted through a first string insertion hole formed in said lead carrier and in each of said plurality of carriers and thereafter being inserted through a second string insertion hole formed in said lead carrier and in each of said plurality of carriers so that said operation string is formed into a continuous loop, and said operation string being connected to said lead carrier for controlling movement of said lead carrier within said hanger rail;

a mechanical connector interconnecting said plurality of carriers and said lead carrier so that as said lead carrier is reciprocated within and along said hanger rail by said operation string, said plurality of carriers are also similarly reciprocated;

said lead carrier and said plurality of carriers each include a rotation mechanism for rotating a supported louver about a vertical axis and a shaft insertion hole receiving an operation shaft for engaging and operating said rotation mechanism; and means for preventing rotary moment from being applied to said lead carrier when said operation string is reciprocated;

wherein said means for preventing rotary moment from being applied to said lead carrier is an attachment member which is detachably attached to said lead carrier and engages with said operation shaft at a location spaced from the engagement of said operation shaft and said rotation mechanism to prevent rotary moment from being applied to said lead carrier during reciprocation of said operation string.

15. A vertical blind according to claim 14, wherein said mechanical connector is a scissor-type connector interconnecting said plurality of carriers with said lead carrier for simultaneous movement of said plurality of carriers and said lead carrier.

16. A vertical blind according to claim 14, wherein an electric motor, having a drive mechanism, is drivingly connected to said operation string for controlling operation of said operation string, and said electric motor is connected to an electrical control mechanism for controlling operation of said electric motor.

* * * * *